US007797155B2

(12) United States Patent
Konda et al.

(10) Patent No.: US 7,797,155 B2
(45) Date of Patent: Sep. 14, 2010

(54) SYSTEM AND METHOD FOR MEASUREMENT OF PERCEIVABLE QUANTIZATION NOISE IN PERCEPTUAL AUDIO CODERS

(75) Inventors: Preethi Konda, Karnataka (IN); Ameet Kalagi, Belgaum (IN)

(73) Assignee: Ittiam Systems (P) Ltd., Bangalore, Karnataka (IN)

( * ) Notice: Subject to any disclaimer, the term of this patent is extended or adjusted under 35 U.S.C. 154(b) by 634 days.

(21) Appl. No.: 11/557,977

(22) Filed: Nov. 9, 2006

(65) Prior Publication Data

US 2008/0027721 A1 Jan. 31, 2008

(30) Foreign Application Priority Data

Jul. 26, 2006 (IN) ..... 1295/CHE/2006

(51) Int. Cl.
*G10L 19/00* (2006.01)
*G10L 19/12* (2006.01)
*G10L 21/02* (2006.01)

(52) U.S. Cl. ..... 704/230; 704/200.1; 704/223; 704/227; 704/500

(58) Field of Classification Search ..... 704/230, 704/223, 220.1, 500, 227
See application file for complete search history.

(56) References Cited

U.S. PATENT DOCUMENTS

| | | | | | |
|---|---|---|---|---|---|
| 5,623,577 | A * | 4/1997 | Fielder | ..... | 704/200.1 |
| 5,812,971 | A * | 9/1998 | Herre | ..... | 704/230 |
| 5,974,380 | A * | 10/1999 | Smyth et al. | ..... | 704/229 |
| 6,393,392 | B1 * | 5/2002 | Minde | ..... | 704/220 |
| 7,146,313 | B2 * | 12/2006 | Chen et al. | ..... | 704/230 |
| 7,240,001 | B2 * | 7/2007 | Chen et al. | ..... | 704/230 |
| RE40,280 | E * | 4/2008 | Johnston | ..... | 704/200.1 |

OTHER PUBLICATIONS

EIC Search Report May 14, 2010.*

* cited by examiner

*Primary Examiner*—David R Hudspeth
*Assistant Examiner*—Edgar Guerra-Erazo
(74) *Attorney, Agent, or Firm*—Prakash Nama; Global IP Services, PLLC

(57) ABSTRACT

A technique for computing perceptual noise in an audio signal that is computationally efficient. In one example embodiment, the technique includes computing perceptual noise in an input audio signal. The steps involve pre-computing NER (noise-to-excitation ratio) values associated with critical bands within a frame by zeroing out associated spectral coefficient values before the quantization loop, and also assuming bands with lower spectral energy than the band under consideration are zeroed out during quantization. When a critical band is zeroed out during quantization, the associated NER values which have been pre-computed are used in computing an overall perceptual distortion of the frame.

9 Claims, 2 Drawing Sheets

SYSTEM AND METHOD FOR MEASUREMENT OF PERCEIVABLE QUANTIZATION NOISE IN PERCEPTUAL AUDIO CODERS

This application claims priority under 35 USC Þ119 (e) (1) of provisional application number 1295/CHE/2006, Filed on Jul. 26, 2006.

TECHNICAL FIELD OF THE INVENTION

The present invention relates generally to audio compression and particularly for measurement of perceptual noise.

BACKGROUND OF THE INVENTION

Quantizer which is used in a perceptual audio coder to quantize spectral coefficients is advantageously controlled by a psychoacoustic model (i.e., a model based on the performance of the human auditory system) to determine excitation (perceivable energy) for groups of neighboring spectral lines referred to as a critical band. The perceptual model is used to detect perceptual irrelevancies in the audio data presented to it. Most audio encoders operate on frames of data.

A typical perceptual audio encoder includes a time-frequency analysis block, a psychoacoustic analysis block, and a quantization block. The psychoacoustic analysis block determines the amount of quantization noise that can be introduced by the encoder without introducing any perceivable noise. The time-frequency block transforms the input audio signal into the spectral domain, which is amenable to quantization and encoding in accordance with a perceptual distortion metric. If the quantization noise introduced by the encoder lies below perceptual distortion metric, the encoder is said to have maintained perceptually transparent audio quality.

Overall quality of an audio signal is measured by the weighted sum of noise-to-excitation ratios (NERs) of individual critical bands. A critical band is a group of spectral lines defined by psychoacoustic model based on the human auditory system. Inputs to quality measurements are, original spectral coefficients X[k], reconstructed (i.e., inverse quantized) spectral coefficients Xr[k], and a weight array W giving relative importance of critical bands in the computation of weighted sum NER.

Conventional techniques carry out quantization in two loops in order to satisfy perceptual distortion criteria and bit rate criteria. The two loops to satisfy the perceptual distortion (quality loop) and the bit rate criteria (bit-rate loop) are run over the spectral lines within a frame. In these loops, the quantization step size is adjusted in order to fit the spectral lines within a given bit rate, while maintaining minimal distortion, so as to maintain constant bit-rate over a specified period of time.

As described-above the psychoacoustic analysis is performed on a frame-by-frame basis which feeds in the excitation to the quantizer. At low bit rate some critical bands may be zeroed out due to the coarseness of quantization, which can lead to poor audio quality. The zeroing out of a critical band should reflect in the measurement on NER so that the bits allocated to this critical band can be adjusted to avoid resulting in poor audio quality. The zeroing out of a critical band is indicated pre-dominantly for a band when the re-constructed spectral coefficients are used to calculate the excitation. This may force the quality loop to re-adjust the step-size so as to avoid zeroing out of the critical band. Hence, in the quality loop, excitation needs to be calculated each iteration. This can lead to high computational complexity, as the excitation needs to be calculated each quantization iteration by the psychoacoustic model. In summary, the computation of the perceptual noise, while maintaining the perceptual quality, is generally complex using the above conventional technique.

SUMMARY OF THE INVENTION

The present invention aims to provide a method for measuring perceptual noise introduced through the quantization process in perceptual audio coders. According to an aspect of the invention, there is provided a method for computing perceptual noise in an input audio signal, comprising the steps of pre-computing NER (noise-to-excitation ratio) values associated with critical bands within a frame by zeroing out associated spectral coefficient values before the quantization loop, further assuming bands with lower spectral energy than the band under consideration are zeroed out during quantization, and computing an overall perceptual distortion of the frame using pre-computed NER values associated with the critical bands.

BRIEF DESCRIPTION OF THE DRAWINGS

A more detailed understanding of the invention may be had from the following description of preferred embodiments, given by way of example only, and to be understood in conjunction with the accompanying drawings in which.

DETAILED DESCRIPTION

In the following detailed description of the various embodiments of the invention, reference is made to the accompanying drawings that form a part hereof, and in which are shown by way of illustration specific embodiments in which the invention may be practiced. These embodiments are described in sufficient detail to enable those skilled in the art to practice the invention, and it is to be understood that other embodiments may be utilized and that changes may be made without departing from the scope of the present invention. The following detailed description is, therefore, not to be taken in a limiting sense, and the scope of the present invention is defined only by the appended claims and their equivalents.

Figure 1:
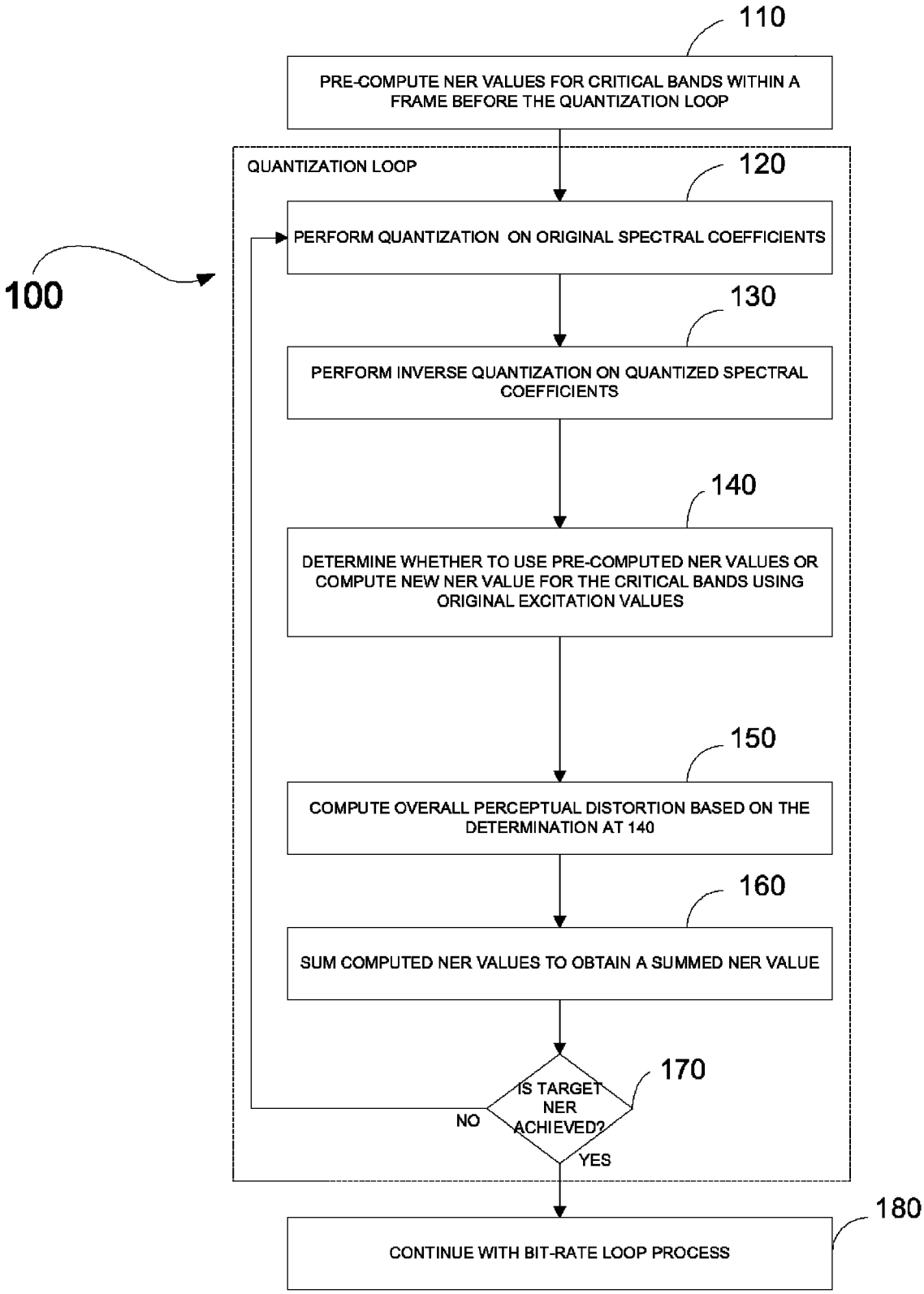
FIG. 1 is a flowchart illustrating measurement of perceptual noise according to an embodiment of the present subject matter.

Referring to FIG. 1, at step 110, the method 100 in this example embodiment begins by pre-computing NER (noise-to-excitation ratio) values associated with each critical band within a frame by zeroing out associated spectral coefficient values, before the quantization loop. In some embodiments, NER for each critical band is computed as follows.

The noise is calculated assuming that the reconstructed values are zero for each critical band. The noise for each critical band is calculated using the equation $$NP[b] = \sum_{k=0,B[b]} A^2[k]X^2[k]$$

Wherein X[k] are the original spectral coefficients, A[k] is an outer ear transform, and B[b] is final excitation values.

The excitation for each critical band is computed assuming that the critical band is zeroed out. All critical bands with spectral coefficient values lower than the current critical band are also assumed to have been zeroed out for the purpose of excitation computation At step 120, a quantization is performed on the original spectral coefficients associated with each of the critical bands within the frame to obtain quantized spectral coefficients. In some embodiments, an encoder applies a uniform, scalar quantization step size to a block of spectral data that was previously weighted by critical bands according to a quantization matrix. Alternatively, the encoder applies a non-uniform quantization to weight the block by quantization bands, or applies the quantization matrix and the uniform, scalar quantization step size.

At step 130, an inverse quantization is performed on the obtained quantized spectral coefficients for each of the critical bands within the frame to obtain reconstructed spectral coefficients. In some embodiments, an encoder reconstructs the block of spectral data from the quantized data. For example, the encoder applies the inverse quantization to reconstruct the block, and then applies an inverse multi-channel transform to return the block to independently coded channels.

In these embodiments, the encoder processes the reconstructed block in critical bands according to an auditory model. The number and placement of the critical bands depends on the auditory model, and may be different from the number and placement of quantization bands. By processing the block by critical bands, the encoder improves the accuracy of subsequent quality measurements.

At step 140, the method 100 determines whether to use pre-computed NER values associated with the critical bands as a function of the obtained reconstructed spectral coefficients or to compute new NER value for the critical bands using original excitation values This step involves measuring quality of the reconstructed block, for example, measuring the NER as described above.

In some embodiments, noise pattern between original transform coefficients X[k] and the reconstructed transform coefficients Xr[k] is computed by calculating sample by sample differences N[k]. An outer ear transfer function A is applied to the difference to obtain N[k], as described below.

$$N[k]=A[k](X[k]-Xr[k])$$

Using the distortion coefficients N[k] thus obtained, the noise pattern in critical band 'b' is accumulated, over the length of the critical band B[b] as described-above.

$$NP[b] = \sum_{k=0,B[b]} N^2[k]$$

In some embodiments, the excitation pattern is computed using below outlined steps. Transform coefficients X[k] are multiplied by the outer ear transform A[k] to obtain Y[k]

$$Y[k]=X[k]*A[k]$$

The energy of the coefficients Y[k] are summed up for all critical bands to obtain En[b]

$$En[b] = \sum_{k=0,B[b]} Y^2[k]$$

Frequency smearing is performed on En[b] bands. This can involve a process of convolution of En[b] with a level dependent spreading function to obtain Ec[b]. This spreading function models the frequency masking phenomenon of the inner ear.

Time smearing is performed on Ec[b] to obtain the final excitation values E[b]. Time smearing can involve first order low pass filtering on the excitation values on a per-band basis.

$$E[b]=\alpha EPrev[b]+(1-\alpha)Ec[b]$$

Wherein $E_{prev}[b]$ is an excitation value corresponding to the previous frame.

At step 150, an overall perceptual distortion of the frame is computed by using either the pre-computed NER values or new NER values computed using the original excitation values based on the determination at step 140.

At step 160, the computed NER values associated with the critical bands are summed to obtain a summed NER value. At step 170, the method 100 compares the summed NER value with a target NER value and determines whether a target NER is achieved. The method 100 goes to step 180 and continues with the bit-rate loop process if the target NER is achieved. The method 100 goes to step 120 and repeats steps 120-170 if the target NER is not achieved.

Although the method 100 includes steps 110-180 that are arranged serially in the exemplary embodiments, other embodiments of the present subject matter may execute two or more acts in parallel, using multiple processors or a single processor organized two or more virtual machines or sub-processors. Moreover, still other embodiments may implement the acts as two or more specific interconnected hardware modules with related control and data signals communicated between and through the modules, or as portions of an application-specific integrated circuit. Thus, the exemplary process flow diagrams are applicable to software, firmware, and/or hardware implementations.

Various embodiments of the present invention can be implemented in software, which may be run in the environment shown in FIG. 2 (to be described below) or in any other suitable computing environment. The embodiments of the present invention are operable in a number of general-purpose or special-purpose computing environments. Some computing environments include personal computers, general-purpose computers, server computers, hand-held devices (including, but not limited to, telephones and personal digital assistants (PDAs) of all types), laptop devices, multi-processors, microprocessors, set-top boxes, programmable consumer electronics, network computers, minicomputers, mainframe computers, distributed computing environments and the like to decode code stored on a computer-readable medium. The embodiments of the present invention may be implemented in part or in whole as machine-executable instructions, such as program modules that are decoded by a computer. Generally, program modules include routines, programs, objects, components, data structures, and the like to perform particular tasks or to implement particular abstract data types. In a distributed computing environment, program modules may be located in local or remote storage devices.

Figure 2:
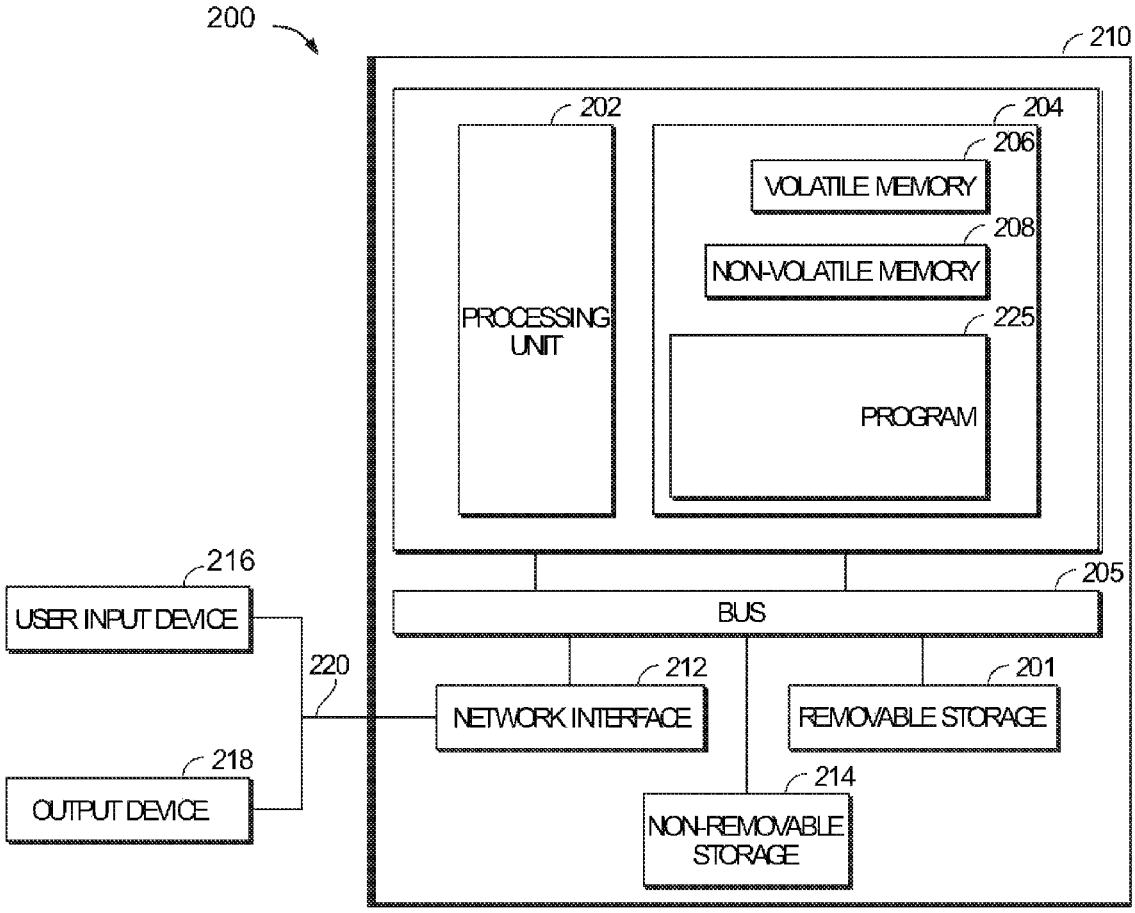
FIG. 2 is an example of a suitable computing environment for implementing the measurement of perceptual noise according to various embodiments of the present invention, such as those shown in FIGS. 1 and 2.

FIG. 2 shows an example of a suitable computing system environment for implementing embodiments of the present invention. FIG. 2 and the following discussion are intended to provide a brief, general description of a suitable computing environment in which certain embodiments of the inventive concepts contained herein may be implemented.

A general computing device, in the form of a computer 210, may include a processor 202, memory 204, removable storage 201, and non-removable storage 214. Computer 210 additionally includes a bus 205 and a storage area network interface (NI) 212.

Computer 210 may include or have access to a utility computing environment that includes one or more computing servers 240 and one or more disk arrays 260, a SAN 250 and one or more communication connections 220 such as a network interface card or a USB connection. The computer 210 may operate in a networked environment using the communication connection 220 to connect to the one or more computing servers 240. A remote server may include a personal computer, server, router, network PC, a peer device or other network node, and/or the like. The communication connection may include a Local Area Network (LAN), a Wide Area Network (WAN), and/or other networks.

The memory 204 may include volatile memory 206 and non-volatile memory 208. A variety of computer-readable media may be stored in and accessed from the memory elements of computer 210, such as volatile memory 206 and non-volatile memory 208, removable storage 212 and non-removable storage 214. Computer memory elements can include any suitable memory device(s) for storing data and machine-readable instructions, such as read only memory (ROM), random access memory (RAM), erasable programmable read only memory (EPROM), electrically erasable programmable read only memory (EEPROM), hard drive, removable media drive for handling compact disks (CDs), digital video disks (DVDs), diskettes, magnetic tape cartridges, memory cards, Memory Sticks™, and the like; chemical storage; biological storage; and other types of data storage.

"Processor" as used herein, means any type of computational circuit, such as, but not limited to, a microprocessor, a microcontroller, a complex instruction set computing (CISC) microprocessor, a reduced instruction set computing (RISC) microprocessor, a very long instruction word (VLIW) microprocessor, explicitly parallel instruction computing (EPIC) microprocessor, a graphics processor, a digital signal processor, or any other type of processor or processing circuit. The term also includes embedded controllers, such as generic or programmable logic devices or arrays, application specific integrated circuits, single-chip computers, smart cards, and the like.

Embodiments of the present invention may be implemented in conjunction with program modules, including functions, procedures, data structures, application programs, etc., for performing tasks, or defining abstract data types or low-level hardware contexts.

Machine-readable instructions stored on any of the above-mentioned storage media are executable by the processor 202 of the computer 210. For example, a computer program 225 may comprise machine-readable instructions capable of measuring perceptual noise according to the teachings and herein described embodiments of the present invention. In one embodiment, the computer program 225 may be included on a CD-ROM and loaded from the CD-ROM to a hard drive in non-volatile memory 208. The machine-readable instructions cause the computer 210 to estimate SFO according to the various embodiments of the present invention.

The perceptual noise estimation technique of the present invention is modular and flexible in terms of usage in the form of a "Distributed Configurable Architecture". As a result, parts of the perceptual estimation system may be placed at different points of a network, depending on the model chosen. For example, the technique can be deployed in a server and the input and output instructions streamed over from a client to the server and back, respectively. Such flexibility allows faster deployment to provide a cost effective solution to changing business needs.

The above description is intended to be illustrative, and not restrictive. Many other embodiments will be apparent to those skilled in the art. The scope of the invention should therefore be determined by the appended claims, along with the full scope of equivalents to which such claims are entitled.

The above-described methods and apparatus provide various embodiments for encoding characters. It is to be understood that the above-description is intended to be illustrative, and not restrictive. Many other embodiments will be apparent to those of skill in the art upon reviewing the above-description. The scope of the subject matter should, therefore, be determined with reference to the following claims, along with the full scope of equivalents to which such claims are entitled. The above-described process reduces the complexity of computing perceptual noise by about 40-50% of the overall traditional quantization techniques, after accounting for the initial calculation of noise-to-excitation ratio for each band as described-above. The above-described process alleviates the conventional iterative process of excitation computation. Further, in the above process the excitation values are computed only once prior to quantization.

As shown herein, the present invention can be implemented in a number of different embodiments, including various methods, a circuit, an I/O device, a system, and an article comprising a machine-accessible medium having associated instructions.

Other embodiments will be readily apparent to those of ordinary skill in the art. The elements, algorithms, and sequence of operations can all be varied to suit particular requirements. The operations described-above with respect to the method 100 illustrated in FIG. 1 can be performed in a different order from those shown and described herein.

FIGS. 1 and 2 are merely representational and are not drawn to scale. Certain proportions thereof may be exaggerated, while others may be minimized. FIGS. 1-2 illustrate various embodiments of the invention that can be understood and appropriately carried out by those of ordinary skill in the art.

It is emphasized that the Abstract is provided to comply with 37 C.F.R. §1.72(b) requiring an Abstract that will allow the reader to quickly ascertain the nature and gist of the technical disclosure. It is submitted with the understanding that it will not be used to interpret or limit the scope or meaning of the claims.

The above-described implementation is intended to be applicable, without limitation, to situations where improvement to an OFDM system is sought, considering the use of SFO estimation. The description hereinabove is intended to be illustrative, and not restrictive. The various embodiments of the method of improving the OFDM system described herein are applicable generally to any OFDM system, and the embodiments described herein are in no way intended to limit the applicability of the invention. Many other embodiments will be apparent to those skilled in the art. The scope of this invention should therefore be determined by the appended claims as supported by the text, along with the full scope of equivalents to which such claims are entitled.

The invention claimed is:

1. A method of computing perceptual noise in an audio signal, comprising:

pre-computing noise values for each critical band within a frame of the audio signal, before entering the quantization loop, as a function of original spectral coefficient values associated with that critical band;

pre-computing an excitation value for each critical band before entering the quantization loop, wherein pre-computing the excitation value for each critical band comprises:

zeroing out original spectral coefficient values of a current critical band and other critical bands in the frame with spectral coefficient energy less than or equal to spectral coefficient energy of the current critical band; and computing the excitation value of the current critical band as a function of original spectral coefficient values of remaining non-zero critical bands in the frame; and computing an overall perceptual distortion of the frame in the quantization loop, wherein computing the overall perceptual distortion of the frame in the quantization loop comprises:

performing quantization on the original spectral coefficients associated with each of the critical bands within the frame to obtain quantized spectral coefficients;

performing inverse quantization on the quantized spectral coefficients for each of the critical bands within the frame to obtain reconstructed spectral coefficients;

computing a noise to excitation ratio (NER) of each critical band, wherein computing the NER of each critical band comprises:

determining whether all the reconstructed spectral coefficients in a critical band are zeroed out due to quantization;

if so, computing the NER of that critical band using the pre-computed noise and excitation values associated with that critical band; and if not, computing a new noise value of that critical band as a function of difference between the original spectral coefficient values and reconstructed spectral coefficient values and computing the NER of that critical band using the new noise value and original excitation value associated with the critical band; and computing an overall perceptual distortion of the frame as a sum of NERs of all the critical bands in the frame.

2. The method of claim 1, further comprising:

summing the computed NER values associated with the critical bands to obtain a summed NER value;

comparing the summed NER value with a target NER value;

determining whether the target NER value is achieved based on an outcome of the comparison; and if so, then continue with the bit-rate loop.

3. The method of claim 2, further comprising:

if not, repeating the steps of performing quantization, performing inverse quantization, determining, using, summing, comparing, and determining.

4. An article comprising:

a non-transitory computer-readable storage medium having instructions that, when executed by a computer, causes the computer to perform a method for computing perceptual noise in an audio signal, comprising:

pre-computing noise values for each critical band within a frame of the audio signal, before entering the quantization loop, as a function of original spectral coefficient values associated with that critical band;

pre-computing an excitation value for each critical band before entering the quantization loop, wherein pre-computing the excitation value for each critical band comprises:

zeroing out original spectral coefficient values of a current critical band and other critical bands in the frame with spectral coefficient energy less than or equal to spectral coefficient energy of the current critical band; and computing the excitation value of the current critical band as a function of original spectral coefficient values of remaining non-zero critical bands in the frame; and computing an overall perceptual distortion of the frame in the quantization loop, wherein computing the overall perceptual distortion of the frame in the quantization loop comprises:

performing quantization on the original spectral coefficients associated with each of the critical bands within the frame to obtain quantized spectral coefficients;

performing inverse quantization on the quantized spectral coefficients for each of the critical bands within the frame to obtain reconstructed spectral coefficients;

computing a noise to excitation ratio (NER) of each critical band, wherein computing the NER of each critical band comprises:

determining whether all the reconstructed spectral coefficients in a critical band are zeroed out due to quantization;

if so, computing the NER of that critical band using the pre-computed noise and excitation values associated with that critical band; and if not, computing a new noise value of that critical band as a function of difference between the original spectral coefficient values and reconstructed spectral coefficient values and computing the NER of that critical band using the new noise value and original excitation value associated with the critical band; and computing an overall perceptual distortion of the frame as a sum of NERs of all the critical bands in the frame.

5. The article of claim 4, further comprising:

summing the computed NER values associated with the critical bands to obtain a summed NER value;

comparing the summed NER value with a target NER value;

determining whether the target NER value is achieved based on an outcome of the comparison; and if so, then continue with the bit-rate loop process.

6. The article of claim 5, further comprising:

if not, repeating the steps of performing quantization, performing inverse quantization, computing, determining, using, summing, comparing, and determining.

7. A computer system comprising:

a computer network, wherein the computer network has a plurality of network elements, and wherein the plurality of network elements has a plurality of network interfaces;

a network interface; an input module coupled to the network interface that receives topology data via the network interface; a processing unit; and a memory coupled to the processor, the memory having stored therein code associated with a method for computing perceptual noise in an audio signal, the code causes the processor to perform the method comprising:

pre-computing noise values for each critical band within a frame of the audio signal, before entering the quantization loop, as a function of original spectral coefficient values associated with that critical band;

pre-computing an excitation value for each critical band before entering the quantization loop, wherein pre-computing the excitation value for each critical band comprises:

zeroing out original spectral coefficient values of a current critical band and other critical bands in the frame with spectral coefficient energy less than or equal to spectral coefficient energy of the current critical band; and computing the excitation value of the current critical band as a function of original spectral coefficient values of remaining non-zero critical bands in the frame; and computing an overall perceptual distortion of the frame in the quantization loop, wherein computing the overall perceptual distortion of the frame in the quantization loop comprises:

performing quantization on the original spectral coefficients associated with each of the critical bands within the frame to obtain quantized spectral coefficients;

performing inverse quantization on the quantized spectral coefficients for each of the critical bands within the frame to obtain reconstructed spectral coefficients;

computing a noise to excitation ratio (NER) of each critical band, wherein computing the NER of each critical band comprises:

determining whether all the reconstructed spectral coefficients in a critical band are zeroed out due to quantization;

if so, computing the NER of that critical band using the pre-computed noise and excitation values associated with that critical band; and if not, computing a new noise value of that critical band as a function of difference between the original spectral coefficient values and reconstructed spectral coefficient values and computing the NER of that critical band using the new noise value and original excitation value associated with the critical band; and computing an overall perceptual distortion of the frame using the pre computed NER values or the new NER values computed using the original excitation values based as a sum of NERs of all the critical bands in the frame.

8. The system of claim 7, further comprising:

summing the computed NER values associated with the critical bands to obtain a summed NER value;

comparing the summed NER value with a target NER value;

determining whether the target NER value is achieved based on an outcome of the comparison; and if so, then continue with the bit-rate loop process.

9. The system of claim 8, further comprising:

if not, repeating the steps of performing quantization, performing inverse quantization, computing, determining, using, summing, comparing, and determining.

* * * * *